US011730338B2

(12) United States Patent
Ben-Daviv et al.

(10) Patent No.: US 11,730,338 B2
(45) Date of Patent: Aug. 22, 2023

(54) APPARATUS, METHOD AND SYSTEM OF WASHING INDUCTION COOKWARE USING INDUCTION HEATING AND HIGH-PRESSURE WATER JET

(71) Applicant: Kitchen Robotics Ltd, Modiin (IL)

(72) Inventors: David Ben-Daviv, Rehovot (IL); Yair Gordin, Modiin (IL)

( * ) Notice: Subject to any disclaimer, the term of this patent is extended or adjusted under 35 U.S.C. 154(b) by 0 days.

(21) Appl. No.: 17/656,883

(22) Filed: Mar. 29, 2022

(65) Prior Publication Data

US 2022/0218178 A1 Jul. 14, 2022

Related U.S. Application Data

(62) Division of application No. 16/908,815, filed on Jun. 23, 2020, now Pat. No. 11,317,782.

(51) Int. Cl.

| | |
|---|---|
| ***A47L 15/16*** | (2006.01) |
| ***A47L 15/00*** | (2006.01) |
| ***A47L 15/42*** | (2006.01) |

(52) U.S. Cl.

CPC ..... *A47L 15/0028* (2013.01); *A47L 15/0036* (2013.01); *A47L 15/0076* (2013.01);

(Continued)

(58) Field of Classification Search

None

See application file for complete search history.

(56) References Cited

U.S. PATENT DOCUMENTS

| | | | |
|---|---|---|---|
| 1,757,909 | A | 5/1930 | Kazaaian |
| 3,858,595 | A | 1/1975 | Schultz |

(Continued)

FOREIGN PATENT DOCUMENTS

| | | | |
|---|---|---|---|
| CN | 108814501 | * | 11/2018 |
| DE | 102017118022 | * | 2/2019 |

(Continued)

OTHER PUBLICATIONS

Translation of DE102017118022 by Hackert, published Feb. 14, 2019.*

(Continued)

*Primary Examiner* — Mikhail Kornakov

*Assistant Examiner* — Ryan L Coleman

(74) *Attorney, Agent, or Firm* — Haim M. Factor

(57) ABSTRACT

A method of washing induction cookware having a cookware content, using induction heating and a water jet, and comprising a washing process having the steps of: heating the cookware during a washing cycle; washing the cookware in the washing cycle with a cold-water jet; drying the cookware after the washing cycle; heat sanitization of the cookware; and steam sanitization of the cookware, whereby the washing process is analyzed by a vision system, the washing process is controlled and adjusted by a controller having parameters varying between each of the cookware content; whereby the parameters are derived from an interfaced cooking apparatus and from a manual input and whereby the vision system serves to regulate a water pressure, a water flow, a heating temperature, and time durations between each of the cookware content, with each of the cookware content having a cooking base, a food contact surface, recipe ingredients cooked, a cooking temperature, and a cooking duration.

1 Claim, 3 Drawing Sheets

(52) U.S. Cl.
CPC ..... *A47L 15/4234* (2013.01); *A47L 15/4236* (2013.01); *A47L 15/4278* (2013.01); *A47L 15/4289* (2013.01); *A47L 15/0034* (2013.01); *A47L 2501/14* (2013.01); *A47L 2501/16* (2013.01)

(56) References Cited

U.S. PATENT DOCUMENTS

| | | | | |
|---|---|---|---|---|
| 5,960,503 | A | 10/1999 | Del Pozo | |
| 2009/0071514 | A1* | 3/2009 | Roth | A47L 15/502 134/56 D |
| 2020/0093347 | A1* | 3/2020 | Shashidhar | A47L 15/4293 |

FOREIGN PATENT DOCUMENTS

| | | | |
|---|---|---|---|
| JP | 2008-229401 | * | 10/2008 |
| WO | WO2017/022975 | * | 2/2017 |
| WO | WO2017/067581 | * | 4/2017 |
| WO | WO2018/162211 | * | 9/2018 |

OTHER PUBLICATIONS

Translation of CN108814501 by Fan, published Nov. 16, 2018.*
Translation of JP2008-229401 by Okajima, published Oct. 2, 2008.*

* cited by examiner

APPARATUS, METHOD AND SYSTEM OF WASHING INDUCTION COOKWARE USING INDUCTION HEATING AND HIGH-PRESSURE WATER JET

FIELD OF THE INVENTION

The present invention is a washing apparatus for induction suitable cookware. The apparatus can be incorporated in restaurants, operated manually or incorporated in automatic cooking systems.

BACKGROUND OF THE INVENTION

Kitchen utensils are commonly washed manually, using the 3-sink system. This time-consuming method is based on chemicals and detergents for cleaning and sanitizing as well as on carrying out strict and predefined procedure. The definition of the washing cycle includes constant durations for each step, as well as constant amounts of detergent and water volumes. The defined water temperature range is limited, considering safety and working conditions of the personal. The process is consistent for every type of cookware, regardless the prior cooking processes and parameters, such as heating temperature and cooking duration, the recipe ingredients etc. Consistency of the process results in energy waste, and environmental effect, most likely using excessive amounts of water and detergents.

Automizing cooking processes requires an in-line approach for washing and sanitizing the utensils. Optimization of the washing cycle will enable cost effective, environmentally friendly process, with durations suitable for automated cooking lines. Despite many novels automatic cooking procedures in vogue, not many of the inventions are directed towards efficient cleansing of the cooking utensils. Some of these are quoted below:

U.S. Pat. No. 5,960,503A titled, "Kitchen utensil cleaning tool" refers to an electric, hydraulic, kitchen utensil cleaning tool, being adapted for use with one hand to wash all types of kitchenware in homes, hotels, restaurants, hospitals, etc. It is operated with water from the kitchen pipe line via a hose. It has three systems: Water, Detergent, and Power Systems. To integrate these systems together it has a main connecting receiving element (MCRE) which has: valves and ducts for water and detergent, a sleeve plug and a seal to couple the hollow shaft of a drive motor to the MCRE. The MCRE is connected to a detergent reservoir having an integrated injector. The detergent is mixed with water in a T connection formed by the water and detergent ducts. The mixture passes through the hollow shaft. Cleaning is performed by a rotating cleaning head at the end of the hollow shaft. The cleaning head has a brush and an annular fiber scrub pad.

U.S. Pat. No. 1,757,909A titled, "Utensil-cleaning machine" cleaning machine by means of which dry soot and burnt grease may be effectually removed from the outside of a utensil, and the utensil afterward thoroughly cleaned and polished, means being also provided for washing both the inside and outside of a vessel or dish and for supporting said vessel or dish during the washing operation.

U.S. Pat. No. 3,858,595A titled, "Utensil washing apparatus" discusses a machine for washing dishes as well as pots and pans includes a rack contacting sensor mechanism for determining whether a dish rack or a pots and pans rack is positioned within the machine. The sensor mechanism distinguishes between the sizes or types of the dish racks and pots and pans racks, and through an electrical circuit automatically adjusts the washer spray pressure depending upon the type of rack located in the machine.

Whereas, in all these invention, different mechanism for cleaning utensils are evolved, but none of these talks of cleaning induction cookware that requires a specialized type of cleaning. The present invention develops a unique and efficient, hitherto unknown method of cleaning utilizing the induction technique, embodied in these along with water applied under pressure.

SUMMARY OF THE INVENTION

An aspect of the present invention is to provide a washing apparatus for induction suitable cookware, applying a water jet while heating the cookware with an induction-based heating element.

A still further aspect of the invention is to provide a washing apparatus, which may be used both as stand-alone and also can be incorporated in automated or robotic systems.

A further aspect of the invention is using a sink, with a water nozzle mounted in the center. The nozzle is static and generates a spray of water or a water jet with a specific geometry, suitable for the cookware dimensions (height and diameter). The nozzle is easily replaceable, manually or automatically, thus adjusting the water jet geometry to the cookware dimensions. A spiral nozzle or a cone nozzle might be used, generating a cone shape water pattern, covering the entire inner surface of the cookware.

Another aspect of the invention is to perform the washing cycle, while the cookware remains static. The cookware is positioned above the sink, while the inner surface, to be washed, is facing the sink and nozzle. The cookware is centered above the nozzle, enabling an even distribution of the water spray pattern or a water jet generated by the nozzle.

Another aspect of the invention is manual or automatic positioning of the cookware. The cookware might be positioned in place manually or moved in position by a motion element. The motion element might be a robotic arm, electrical motor, pneumatic drive.

Another aspect of the invention is the use of a cold-water jet, generating a high velocity of the water droplets. The water droplets gain momentum, generating force on impact with a dirty surface of the cookware. The impact force removes dirt particles from the cookware surface. The droplets velocity depends on the water flow rate and pressure. The flow rates might be between 10 l/min and 40 l/min. The pressure might be between 3 bars and 100 bars.

Another aspect of the invention is to generate the water pressure and flow using a water pump. A centrifugal pump or a high-pressure piston pump might be used to generate the water pressure and the water flow required. The pump might be powered by an electric motor or petrol engine. The pump performance can be regulated by a controller, adjusting the motor frequency thus controlling the pressure and flow values.

Another aspect of the invention is electrical valve, such as a solenoid or a plunger type actuator or a pivoted armature, regulating the water flow.

A further aspect of the invention is adjusting and controlling the water flow and pressure depending on the amount and type of dirt and debris to be removed, thus optimizing the water consumption and washing duration. Considering the cookware content (recipe ingredients cooked) and cooking conditions, such as heating temperature and cooking duration, the washing cycle parameters can be evaluated and adjusted accordingly for each cookware being washed.

A still further aspect of the invention is heating the cookware during the washing cycle. An induction heating unit, in a sealed enclosure, is mounted above the sink. The induction unit contains an induction heating element, generating a magnetic field, heating the cookware. A sealed enclosure provides an IP67 level protection to the induction element and the related components and wiring, in case of a water slash. The induction unit contains a ceramic glass, facing the cookware flat base.

A still further aspect of the invention is controlling and adjusting the heating regime of the cookware during the washing cycle. Considering the cookware content (recipe ingredients cooked) and cooking conditions, such as heating temperature and cooking duration, the heating regime during the washing cycle can be defined and adjusted for each cookware being washed. The heating regime or a heating profile determines the induction power levels over time, relative to the washing cycle. The cookware can be preheated, heated in parallel to applying the water spray and after the water flow is turned off, while the heating intensity might vary, while the induction unit power levels are adjusted.

A still further aspect of the invention is drying the cookware after a washing cycle. The induction unit heating regime can be adjusted to dry the cookware after the washing cycle is complete. Heating the cookware base, after the water spray is turned off, evaporated the remaining water droplets on the cookware surface, leaving it dry.

A still further aspect of the invention is heat sanitization. The apparatus performs a heat sanitization of the cookware as a part of the washing cycle or as a stand-alone process, allowing a food contact surface to be exposed to high heat for a designated period of time. Heat sanitization is performed by heating the cookware to 170° F. while applying a water spray, for defined period of time, which might be 5 to 60 seconds.

Another aspect of the present invention is steam sanitization. Steam sanitization can be performed by the apparatus as a part of the cookware washing cycle or as a stand-alone process, allowing a food contact surface to be heated up to steam-sterilizing temperatures of 250° F. or 270° F. (commonly practiced values, recommended by CDC) while applying water spray. The water droplets, impacting the heated food contact surface, evaporate to steam, sanitizing the surface and quickly killing microorganisms. The duration of the sanitization process and the temperature regime can be controlled and optimized for each cookware, depending on the content ingredients, cooking temperature and duration.

A still further aspect of the present invention is heating the cookware food contact surface above the Leidenfrost point, which is approximately 379° F., thus causing the Leidenfrost effect. The Leidenfrost effect is a physical phenomenon in which a liquid, close to a surface that is significantly hotter than the liquid's boiling point, produces an insulating vapor layer that keeps the liquid from boiling rapidly. Because of this 'repulsive force', a droplet hovers over the surface rather than making physical contact with the hot surface. The motion of the water droplets generates a cleaning effect. Since the vapor layer above the food contact heated surface is approximately 0.2 mm, dirt, debris and remains of food above that height are being impacted by the moving water droplets and the heated vapor layer, separating them from the surface. This effect cleans the food contact surface and sanitizes them.

A still further aspect in the invention is controller, invoking the water pump, the water regulator valve and the induction unit. The controller generates a washing cycle, adjusting the washing, drying and sanitizing parameters, such as pressure, flow, heating temperature and durations.

Another aspect of the invention is a vision system, analyzing the washing process and deriving the optimal parameters for performance sustainability and constant improvement. Water pressure, flow, heating temperature and durations can be adjusted to achieve acceptable performance and energy saving, minimizing water and power consumption.

Another aspect of the invention is the adjustable, controllable washing, drying and sanitizing cycle, that can vary between each cookware processed and washed. The cycle parameters can be derived from an interfaced cooking apparatus, manual input or a vision system. Optimizing the washing, drying and sanitizing parameters for every cookware results in high level of energy consumption efficiency, saving water and electricity.

A still further aspect of the invention is, the apparatus and method help in avoiding detergents and chemicals, thus saving cost and sustaining a green, environmentally clean process. In addition, the cookware as well as the personnel, are not exposed to chemical substances since removal of organic matter, food remains and debris from the cookware is achieved by the impact of water droplets. Further, sanitization of the cookware occurs simultaneously by annihilation of bacteria and microorganisms by exposure to high temperatures and steam, generated by evaporation of the water droplets.

REFERENCE NUMERALS

Figure 1:
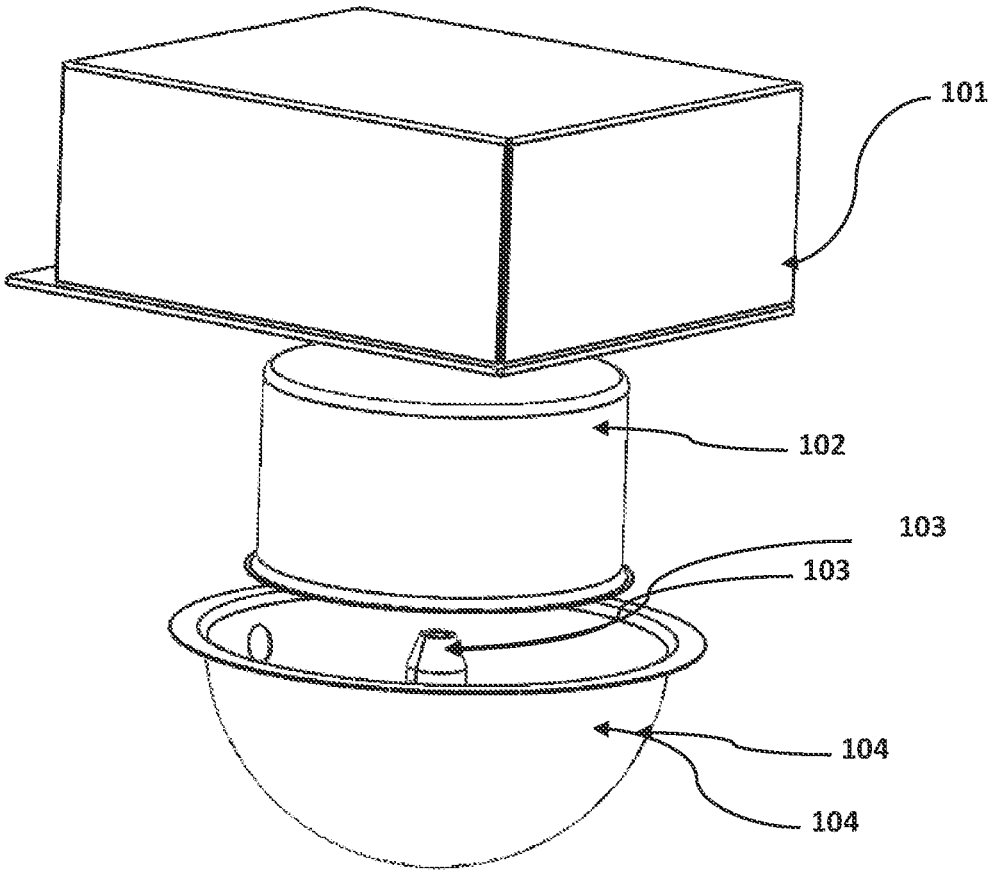
FIG. 1 is the exploded view of the apparatus, showing the induction unit in a sealed enclosure, possible cookware, sink and nozzle.

101 induction unit
102 cookware
103 replaceable water nozzle
104 sink
201 induction element
202 ceramic glass

DETAILED DESCRIPTION OF THE EMBODIMENTS

Figure 2:
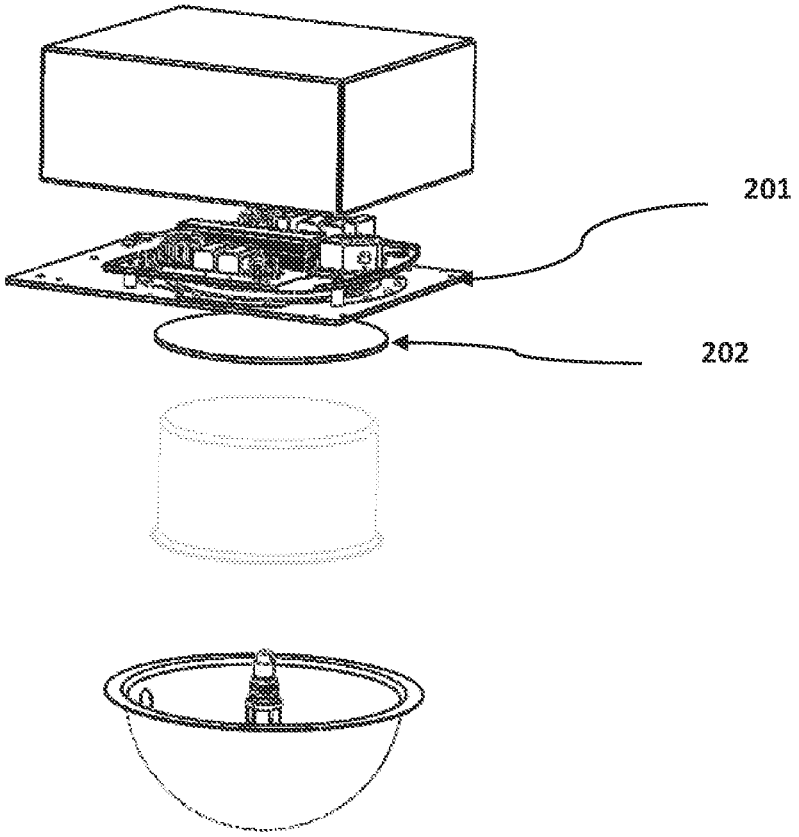
FIG. 2 is the exploded view of the apparatus further detailing the induction element and the ceramic glass.

The following disclosure describes several embodiments of washing apparatus for induction suitable cookware as well as the methods of washing thereof. Specific details of several embodiments of the present disclosure are described below with reference to FIGS. 1 to 3 to provide a thorough understanding of the embodiments. Other details describing well-known structures and systems often associated with washing cookware, however, are not set forth below to avoid unnecessarily obscuring the description of the various embodiments. Accordingly, those of ordinary skill in the art will understand that the invention may have other embodiments in addition to those described below. Such embodiments may include other elements and features in addition to those described below, or they may lack one or more of the features or elements described below.

The apparatus of the present invention comprises of;

an induction unit 101;

replaceable water nozzle 103;

sink 104;

induction element 201;

ceramic glass 202;

In an embodiment of the present invention the apparatus comprises of a sink 104, with a water nozzle 103 mounted in the center of the sink 104. The nozzle 103 is static and generates a spray of water or a water jet with a specific geometry, suitable for the cookware dimensions depending upon the height and diameter of the cookware. The nozzle 103 is easily replaceable, manually or automatically, thus adjusting the water jet geometry to the cookware dimensions. During the washing operation of the cookware, the cookware 102 remains static and is positioned above the sink 104, while the inner surface, to be washed, is faces the sink 104 and nozzle 103. The cookware 102 is centered above the nozzle 103, enabling an even distribution of the water spray pattern or a water jet generated by the nozzle 103.

In some embodiments a spiral nozzle or a cone nozzle might be used, generating a cone shape water pattern, covering the entire inner surface of the cookware.

Figure 3:
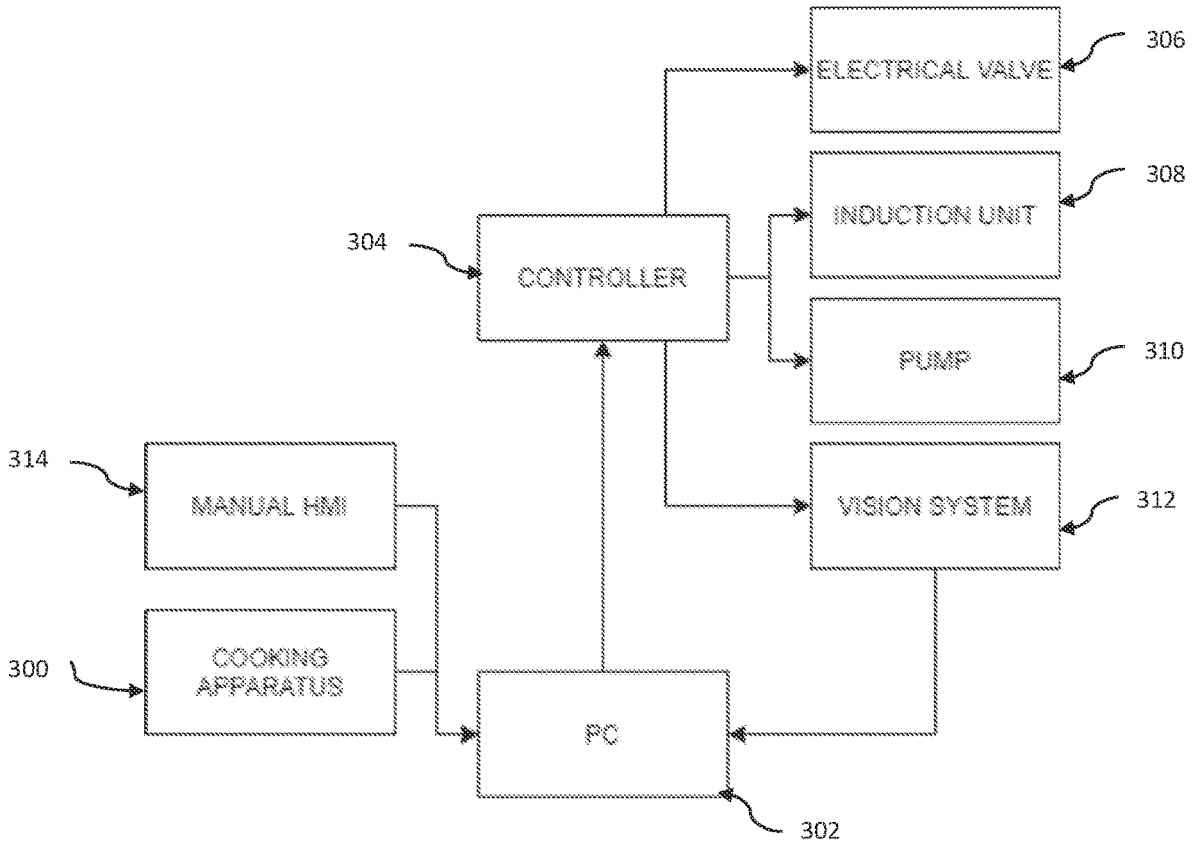
FIG. 3 is the block diagram describing the control interfaces of the apparatus

Referring to FIG. 3, the water pressure and flow required during the washing cycle is generated using a water pump. The pump may be a centrifugal pump or a high-pressure piston pump for generating the water pressure and the water flow required. The pump may be powered by an electric motor or petrol engine. The pump performance may be regulated by a controller, adjusting the motor frequency thus controlling the pressure and flow values.

In some embodiments the water flow may be regulated by an electrical valve, such as a solenoid or a plunger type actuator or a pivoted armature.

In some embodiments the positioning of the cookware may be manual or automatic. The cookware might be positioned in place manually or moved in position by a motion element where the motion element might be a robotic arm, electrical motor or a pneumatic drive.

In some embodiments the washing apparatus, may be used both as stand-alone and also can be incorporated in automated or robotic systems.

In the embodiments of the present invention, the apparatus and method helps in avoiding detergents and chemicals, thus saving cost and sustaining a green, environmentally clean process. In addition, the cookwares, as well as the personnel, are not exposed to chemical substances since removal of organic matter, food remains and debris from the cookware is achieved by the impact of water droplets. Further, sanitization of the cookware occurs simultaneously by annihilation of bacteria and microorganisms by exposure to high temperatures and steam, generated by evaporation of the water droplets.

The apparatus of the present invention involves an elaborate washing cycle for the cleaning and sanitization of the induction cookware which are described below. The steps involve the following:

Heating the cookware during the washing cycle;

Washing the cookware with cold water jet;

Drying the cookware after the washing cycle;

Heat sanitization of the cookware;

Steam sanitization of the cookware.

Heating the cookware during the washing cycle: Referring again to FIGS. 1 and 2, an induction heating unit 101, in a sealed enclosure, is mounted above the sink 104. The induction unit 101 contains an induction heating element 201, generating a magnetic field, thereby heating the cookware 102. A sealed enclosure provides an IP67 level protection to the induction element and the related components and wiring, in case of a water slash. The induction unit contains a ceramic glass 202 facing the cookware flat base which seals the enclosure of the induction element. Since ceramic glass is a non ferrous material, it remains unaffected by the magnetic field generated by the induction element. Further, the ceramic is not heated by the induction element, though the glass might heat up from the hot cookware.

Washing the cookware with cold water jet. In some embodiments the cookware may be cleansed by using cold-water jet. The cold water-jet, generates a high velocity of water droplets. The cleaning is accomplished due to the water droplets gaining momentum, generating a force on impact, with the dirty surface of the cookware. The impact force removes dirt particles from the cookware surface. The droplet's velocity depends on the water flow rate and pressure. The flow rates might be between 10 l/min and 40 l/min and the pressure might be between 3 bars and 100 bars.

Both the water flow and the pressure can be evaluated as well as controlled for each cookware being washed depending on the amount and type of dirt and debris to be removed, thus optimizing the water consumption and washing duration. Other washing cycle parameters to be included for evaluation are the cookware content (recipe ingredients cooked) and cooking conditions, such as heating temperature and cooking duration.

Drying the cookware after the washing cycle. In some embodiments the cookware can be dried after the washing cycle is completed. This is done by heating the cookware base by the induction heating unit 101 after the water spray is turned off which evaporates the remaining water droplets on the cookware surface, thereby leaving the cookware surface dry.

Heat sanitization of the cookware. In some embodiments, the apparatus of the present invention performs heat sanitization of the cookware as a part of the washing cycle or as a stand-alone process, allowing the food contact surface to be exposed to high heat for a designated period of time. Heat sanitization is performed by heating the cookware to 170° F. while applying a water spray, for defined period of time, which might be 5 to 60 seconds.

In some embodiments of the present invention, cleaning and heat sanitization of the food contact surface of the cookware can be performed on the basis of Leidenfrost point. In this process the cookware food contact surface is heated above the Leidenfrost point, which is approximately 379° F., thus causing the Leidenfrost effect.

As is known in the art, the Leidenfrost effect is a physical phenomenon in which a liquid, close to a surface that is significantly hotter than the liquid's boiling point, produces an insulating vapor layer that keeps the liquid from boiling rapidly. Because of this 'repulsive force', a droplet hovers over the surface rather than making physical contact with the hot surface. The motion of the water droplets generates a cleaning effect. Since the vapor layer above the food contact heated surface is approximately 0.2 mm, dirt, debris and remains of food above that height are being impacted by the moving water droplets and the heated vapor layer, separating them from the surface. This effect cleans the food contact surface and sanitizes them.

Steam sanitization of the cookware. In some embodiments of the present invention steam sanitization can be performed by the apparatus as a part of the cookware washing cycle or as a stand-alone process, allowing the food contact surface to be heated up to steam-sterilizing temperatures of 250° F. or 270° F. (commonly practiced values, recommended by CDC) while applying water spray. The water droplets, impacting the heated food contact surface, evaporates to steam, sanitizing the surface and quickly killing microorganisms. The duration of the sanitization process and the temperature regime can be controlled and optimized for each cookware, depending on the content ingredients, cooking temperature and duration.

Referring to FIG. 3, the above apparatus and method works smoothly through a system including the cooking apparatus as described above and depicted as 300 in this figure, a PC 302, a controller 304, an electric valve 306, Induction unit 308, pump 310, vision system 310 and manual HMI or manual Human Machine Interface 314.

The cleaning, washing, drying, heating and sanitization of the cookware is controlled by the controller 304 which receives various inputs from the cooking apparatus 300 and HMI 314.

For initiating the washing cycle, the water pump 310, the water regulator valve 306 and the induction unit 308 is invoked by the controller 304, taking into account the cookware content (recipe ingredients cooked) and cooking conditions received as inputs from the cooking apparatus 300 and the HMI 314. The controller 304 generates a washing cycle, adjusting the washing, drying and sanitizing parameters, such as pressure, flow, heating temperature and durations.

In some embodiments controlling and adjusting of the heating regime of the cookware during the washing cycle is done by the controller as described above. Considering the cookware content (recipe ingredients cooked) and cooking conditions, such as heating temperature and cooking duration, the heating regime during the washing cycle can be defined and adjusted for each cookware being washed. The heating regime or a heating profile determines the induction power levels over time, relative to the washing cycle. The cookware can be preheated, heated in parallel to applying the water spray and after the water flow is turned off. The heating intensity might vary, while the induction unit power levels are adjusted.

In some embodiments the system may comprise of a vision system 312, which analyzes the washing process and derives optimal parameters for performance sustainability and constant improvement. This system helps to adjust the water pressure, flow, heating temperature and durations for achieving acceptable performance and energy saving thereby, minimizing water and power consumption.

In some embodiments, the washing, drying and sanitizing cycle, is adjustable and controllable which varies between each cookware processed and washed. The cycle parameters can be derived from an interfaced cooking apparatus, manual input or a vision system. Optimizing the washing, drying and sanitizing parameters for every cookware results in high level of energy consumption efficiency, saving water and electricity.

The present disclosed subject matter may be a system, a method, and/or a computer program product. The computer program product may include a computer readable storage medium (or media) having computer readable program instructions thereon for causing a processor to carry out aspects of the present disclosed subject matter. The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire. Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device. Computer readable program instructions for carrying out operations of the present disclosed subject matter may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosed subject matter. Aspects of the present disclosed subject matter are described herein with reference to flowchart illustrations and/or block diagrams of methods, apparatus (systems), and computer program products according to embodiments of the disclosed subject matter. It will be understood that each block of the flowchart illustrations and/or block diagrams, and combinations of blocks in the flowchart illustrations and/or block diagrams, can be implemented by computer readable program instructions. These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks. The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosed subject matter. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the disclosed subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosed subject matter has been presented for purposes of illustration and description, but is not intended to be exhaustive or limited to the disclosed subject matter in the form disclosed. Many modifications and variations will be apparent to those of ordinary skill in the art without departing from the scope and spirit of the disclosed subject matter. The embodiment was chosen and described in order to best explain the principles of the disclosed subject matter and the practical application, and to enable others of ordinary skill in the art to understand the disclosed subject matter for various embodiments with various modifications as are suited to the particular use contemplated.

The invention claimed is:

1. A method of washing and sanitizing induction cookware positioned within a washing apparatus, the apparatus comprising:

an induction heating unit;

a replaceable water nozzle;

a sink;

a piece of ceramic glass;

a water pump;

an electric motor;

a vision system;

a controller; and wherein the water nozzle is a static water nozzle mounted at the center of the sink, wherein the water nozzle generates a spray of water with a specific geometry, wherein the induction cookware to be washed remains static and is positioned centrally above the water nozzle and the sink, wherein the induction heating unit has an induction heating element in a sealed enclosure, which comprises the piece of ceramic glass, and wherein the induction heating unit is positioned vertically above the sink and is configured to heat the induction cookware while the induction cookware is positioned between the sink and the induction heating unit;

whereby the method comprises the steps of:

a. heating the cookware with the induction heating unit during a washing cycle;

b. washing the cookware with the spray of water during the washing cycle;

c. heat sanitization of the cookware; and d. steam sanitization of the cookware.

* * * * *